US006151477A

United States Patent [19]

Takeuchi et al.

[11] Patent Number: 6,151,477

[45] **Date of Patent: *Nov. 21, 2000**

[54] IMAGE FORMING APPARATUS WITH MOVABLE MEMBER FOR RECEIVING IMAGE TRANSFERRED FROM IMAGE BEARING MEMBER

[75] Inventors: Akihiko Takeuchi, Yokohama; Toshihiko Ochiai, Tokyo; Motoi Kato, Yokohama; Toshiaki Miyashiro, Ichikawa; Nobuaki Kabeya, Toride; Takehiko Suzuki, Yokohama, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/676,915

[22] Filed: Jul. 8, 1996

Related U.S. Application Data

[63] Continuation of application No. 08/340,397, Nov. 15, 1994, abandoned.

[30] Foreign Application Priority Data

Nov. 19, 1993 [JP] Japan ..... 5-290742

[51] Int. Cl.[7] ..... G03G 15/16

[52] U.S. Cl. ..... 399/318; 399/297; 399/301; 399/303; 399/313

[58] Field of Search ..... 399/297, 298, 399/301, 303, 304, 310, 313, 314, 316, 318

[56] References Cited

U.S. PATENT DOCUMENTS

| | | | |
|---|---|---|---|
| 5,038,178 | 8/1991 | Hosoya et al. | 355/277 |
| 5,130,758 | 7/1992 | Takeda et al. | 355/271 X |
| 5,153,654 | 10/1992 | Yuminamochi et al. . | |
| 5,223,900 | 6/1993 | Yuminamochi et al. . | |
| 5,250,994 | 10/1993 | Ito et al. . | |
| 5,390,012 | 2/1995 | Miyashiro et al. | 355/277 X |
| 5,398,107 | 3/1995 | Bartholmae et al. | 355/271 X |
| 5,402,218 | 3/1995 | Miyashiro et al. | 355/274 |

FOREIGN PATENT DOCUMENTS

| | | |
|---|---|---|
| 548803 | 6/1993 | European Pat. Off. . |
| 2607727 | 9/1976 | Germany . |
| 50-50935 | 5/1975 | Japan . |
| 50-93437 | 7/1975 | Japan . |
| 59-45162 | 3/1984 | Japan . |
| 2-291578 | 12/1990 | Japan . |

*Primary Examiner*—Sandra Brase
*Attorney, Agent, or Firm*—Fitzpatrick, Cella, Harper & Scinto

[57] ABSTRACT

An image forming apparatus comprises an image bearing member for bearing an image, and a movable member which is abutted against the image bearing member and onto which the image on the image bearing member is transferred. The movable member includes a substrate, a sheet-like member, and an elastic layer disposed between the substrate and the sheet-like member and compressed to a predetermined thickness before the movable member is abutted against the image bearing member.

42 Claims, 8 Drawing Sheets

IMAGE FORMING APPARATUS WITH MOVABLE MEMBER FOR RECEIVING IMAGE TRANSFERRED FROM IMAGE BEARING MEMBER

This application is a continuation of application Ser. No. 08/340,397, filed Nov. 15, 1994, now abandoned.

BACKGROUND OF THE INVENTION

1. Field of the Invention

The present invention relates to an image forming apparatus wherein an image formed on an image bearing member is transferred onto a movable body. More particularly, it relates to an image forming apparatus wherein an image formed on an image bearing member is transferred onto a transfer sheet borne on a movable body such a transfer drum to form an image on the transfer sheet.

2. Related Background Art

As a way for obtaining an image by transferring an image formed on an image bearing member onto a transfer sheet borne on a transfer drum, there has been proposed a method wherein a color image is formed on a transfer sheet by superimposing a plurality of different color toner images on the transfer sheet by repeating steps for forming the toner image on an image bearing member by charging, exposure and development and for transferring the toner image onto the transfer sheet whenever the toner image is formed. Such a color image forming apparatus is disclosed in the German Patent No. 2607727 and the Japanese Patent Laid-open Application No. 50-50935 and is put into practical use.

By the way, in such conventional color image forming apparatuses, the transfer sheet is wound around a transfer drum constituted by a pair of ring members, a connection member connecting between the ring members, and a high resistive sheet or film covering an opening defined by the ring members and the connection member. However, in such a transfer drum, independent charge means are required as an absorb charger, a transfer charger, a separation charger and an electricity removal charger for the transfer sheet, and there is a problem regarding the strength and handling of the transfer drum, since the opening defined by the ring members and the connection member is closed by the high resistive film.

On the other hand, to eliminate the above problem, as disclosed in EP-A-548803, the inventors have proposed a transfer device comprising a transfer drum constituted by laminating an elastic layer and a high resistive film on a conductive cylinder.

In such a transfer device, the transferring operation by using the transfer drum constituted by laminating the elastic layer and the high resistive film on the conductive cylinder is effected by forming a nip between the image bearing member and the transfer drum, and the transferring efficiency is greatly influenced upon a width of the nip. The nip width is determined by an compressed amount t of the elastic layer of the transfer drum against the image bearing member, i.e. a difference between a radius of the transfer drum at the nip between the image bearing member and the transfer drum and a radius of the transfer drum when the drum is not abutted against the image bearing member. Thus, an outer diameter of the transfer drum must be formed with high accuracy.

That is to say, if the compressed amount t of the elastic layer is too small, the nip width will be insufficient to adequately urge the transfer sheet on the transfer drum against the image bearing member, thereby causing the poor transferring. On the other hand, if the compressed amount t is too great, the urging pressure of the transfer sheet against the image bearing member will be increased excessively, thereby causing the void in fine lines in the image or the peeling of the transfer sheet from the transfer drum due to the great flexure of the transfer sheet at the nip. Further, since the outer diameter of the transfer drum is great, a moving speed of the transfer sheet borne on the transfer drum is increased, thereby causing the elongation of the image and the deviation in color registration.

On the other hand, hardness of the elastic layer must be low in order to reduce the urging pressure between the transfer drum and the image bearing member at the nip, thereby preventing the void. Accordingly, eventually, the workability of the elastic layer is worsened, with the result that it is very difficult to form the outer diameter of the transfer drum with high accuracy and to make the surface of the transfer drum uniform and smooth.

SUMMARY OF THE INVENTION

An object of the present invention is to provide an image forming apparatus in which an image formed on an image bearing member can be transferred onto a transfer sheet without poor transferring.

Another object of the present invention is to improve close contact between an image bearing member and a movable body.

A further object of the present invention is to improve dimensional accuracy of a movable body.

These and other objects and features of the present invention will be apparent from the following detailed description of the present invention.

DETAILED DESCRIPTION OF THE PREFERRED EMBODIMENTS

Figure 5:
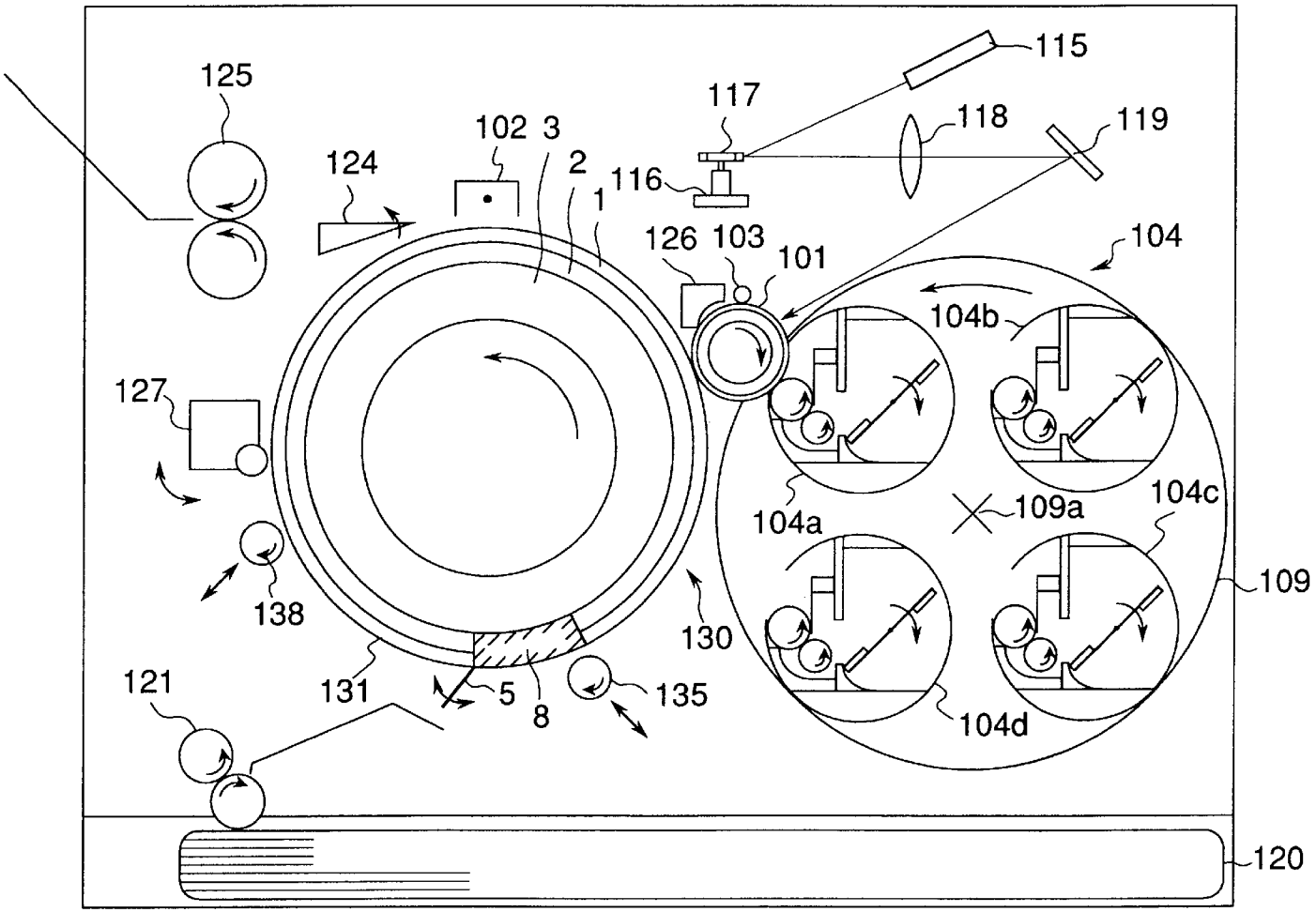
FIG. 5 is an elevational sectional view of a color image forming apparatus according to an embodiment of the present invention.

As shown in FIG. 5 which is an elevational sectional view of a color image forming apparatus according to an embodiment of the present invention, the image forming apparatus comprises an electrophotographic photosensitive drum (image bearing member) 101. Around the photosensitive drum 101, there are arranged a first charger 103 comprised of a roller electrode, a rotary developing means 104 including a plurality of developing devices, a transfer device 130, and a cleaning device 126. Further, above the photosensitive drum 101, there are arranged a laser diode 115, a polygon mirror 117 driven by a high speed motor 116, a lens 118, and a reflection mirror 119.

The photosensitive drum 101 comprises an aluminium cylinder having a diameter of 40 mm, and a photoconductive layer made of organic photosensitive material (OPC) and coated on an outer surface of the cylinder. The photo-conductive layer may be made of amorphous Si, CdS, Se or the like. The photosensitive drum 101 is rotated in a direction shown by the arrow at a peripheral speed of, for example, 100 mm/sec by a drive means (not shown).

The developing means 104 comprises a support 109 rotatable around a central axis 109*a*, and a yellow developing device 104*a*, a magenta developing device 104*b*, a cyan developing device 104*c* and a black developing device 104*d*, which developing devices are supported by the support 109. The developing devices 104*a* to 104*d* include therein one-component yellow toner, magenta toner, cyan toner and black toner, respectively.

Figure 6:
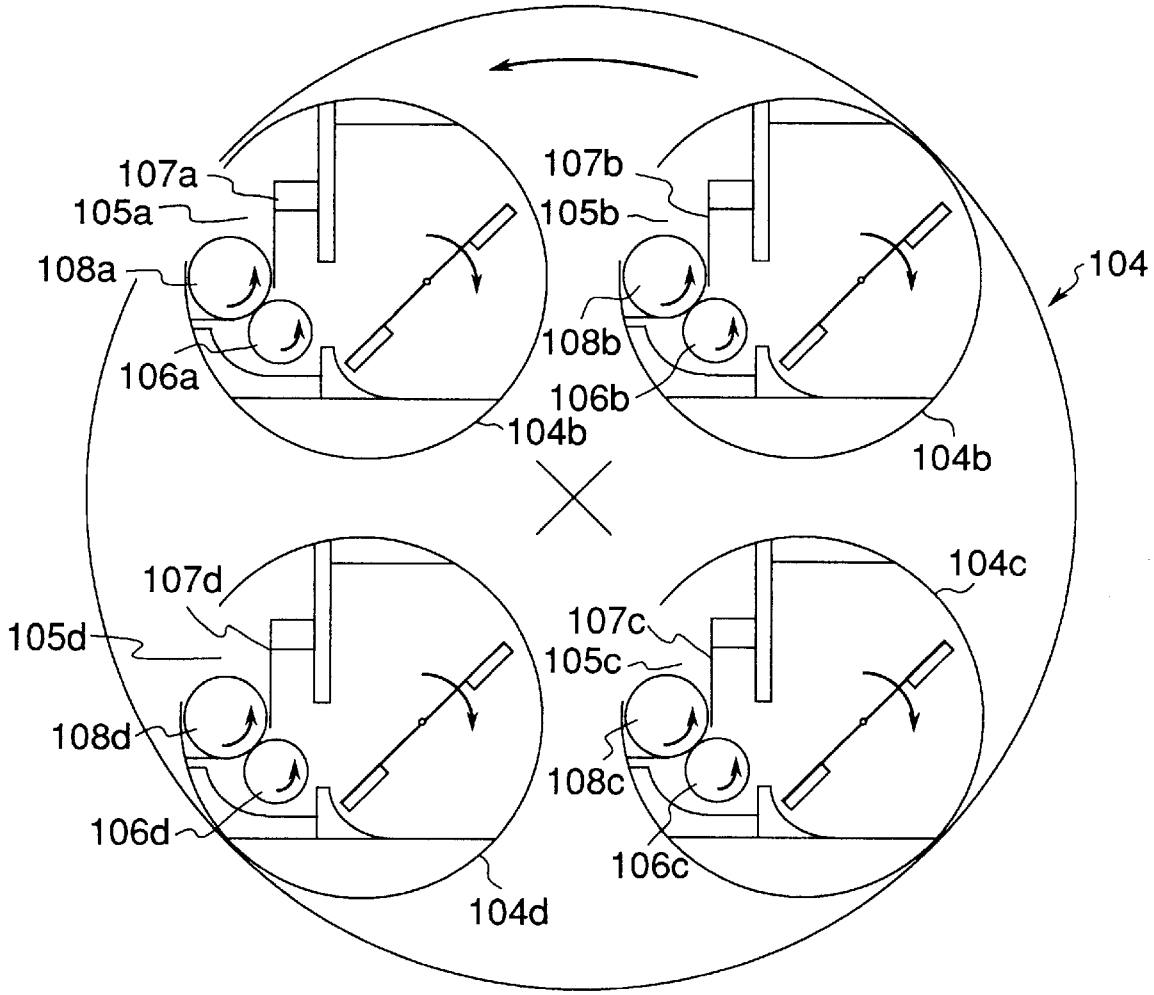
FIG. 6 is a sectional view of a developing device of the color image forming apparatus.

As shown in FIG. 6, in the developing devices 104*a* to 104*d*, there are arranged developing sleeves (developer bearing members) 108*a*, 108*b*, 108*c* and 108*d* disposed at openings 105*a*, 105*b*, 105*c* and 105*d*, respectively. Further, in the developing devices 104*a* to 104*d*, there are arranged coating rollers 106*a*, 106*b*, 106*c* and 106*d* and toner regulating members 107*a*, 107*b*, 107*c* and 107*d*, respectively. When the developing sleeves 108*a* to 108*d* are rotated, the toner is coated on the developing sleeves 108*a* to 108*d* by the coating rollers 106*a* to 106*d*, and the coated toner is regulated by the toner regulating members 107*a* to 107*d* to form thin toner layers on the developing sleeves 108*a* to 108*d*. And, at the same time, friction charges are applied to the toner layer by the toner regulating members. Preferably, the toner regulating members 107*a* to 107*d* are made of material which can be charged with polarity opposite to charging polarity of the toner. Thus, if the toner is charged with negative polarity, the toner regulating members may be made of nylon; whereas, if the toner is charged with positive polarity, the toner regulating members may be made of silicone rubber.

Peripheral speeds of the developing sleeves 108*a* to 108*d* of the developing devices 104*a* to 104*d* are preferably selected so that each peripheral speed becomes greater than a peripheral speed of the photosensitive drum 101 by 1.0–2.0 times. When each developing device 104*a* to 104*d* is opposed to the photosensitive drum 101, each opening 105*a* to 105*d* always faces the photosensitive drum 101. The details of a method for driving the developing devices 104*a* to 104*d* are disclosed in the Japanese Patent Laid-open No. 50-93437.

Next, the transfer device 130 comprising a solid transfer drum 131 will be explained with reference to FIG. 5.

The transfer device 130 comprises the transfer drum (transfer sheet bearing member) 131 around which an absorb roller 135, an electricity removal charger 102, a separation pawl 124, a cleaner 127 and an electricity removal roller 138 are arranged. Grippers 5for gripping a transfer sheet and a support portion 8 for supporting the grippers are arranged on an outer peripheral surface of the transfer drum 131. The transfer drum 131 is rotated in a direction shown by the arrow by means of a drive means (not shown).

The transfer drum 131 is constituted by a cylindrical aluminium conductive substrate 3 to which a voltage having polarity opposite to that of the toner can be applied, a conductive elastic layer 2 made of foam rubber or foam resin and bonded on the peripheral surface of the substrate 3, and a high resistive (dielectric) sheet or film 1 having a thickness of about 10–200 $\mu$m and laminated on the elastic layer. The substrate 3, elastic layer 2 and dielectric film 1 are disposed on the whole area of the transfer drum 131 where the transfer sheet is supported.

In place of the fact that the dielectric film 1 is laminated, dielectric material may be coated on the surface of the elastic layer 2. In this case, however, when the elastic layer 2 is deformed at the nip between the transfer drum and the photosensitive drum 101, the dielectric coating may be extended or contracted along the surface thereof to stress the transfer sheet, thereby causing the void in the image. Thus, in function, more preferably, the dielectric film 2 is laminated on the elastic layer 2.

Further, as mentioned above, an outer diameter of the transfer drum 131 must be formed with high accuracy in order to maintain the nip width between the transfer drum and the photosensitive drum within a proper range. In order to maintain the nip width between the transfer drum and the photosensitive drum within the proper range, for example, when Asker F hardness of the elastic layer 2 is 40–80 and a thickness of the elastic layer is 3–10 mm, the compressed amount t must be limited to about 0.4–1.0 mm, and preferably about 0.7–0.9 mm. In order to limit the compressed amount t in this way, the accuracy of the outer diameter of the transfer drum 131 (including the dispersion in the thickness of the elastic layer 2) must be smaller than ±0.3 mm, and preferably ±0.1 mm. In the present invention, such accuracy of the outer diameter of the transfer drum is obtained by a method which will be described later.

On the other hand, the transfer sheet is supplied from a transfer sheet cassette 120, via a pick-up roller 121, to the transfer drum 131 of the transfer device 130 in synchronously with the toner image formed on the photosensitive drum 101. When the transfer drum 131 is rotated in the direction shown by the arrow while gripping the transfer sheet by the grippers 5, the transfer sheet is conveyed to an image transfer station where the transfer drum is opposed to the photosensitive drum 101. Whenever the transfer sheet is sent to the image transfer station, different color toner images successively formed on the photosensitive drum 101 are successively transferred onto the transfer sheet by the transfer voltage applied between the transfer drum 131 and the photosensitive drum 101 from a power source (not shown).

Now, image formating methods will be explained. Such methods include a normal developing method wherein only a non-exposed area of the charged portion is developed, and an inversion developing method wherein an exposed area is developed. In case of the normal developing method, after the image exposure is effected regarding the photosensitive drum 101 uniformly charged by the charge means 103, the toner is charged with polarity opposite to the charging polarity of the charge means 103 to adhere the toner to the non-exposed area of the charged portion. When the toner image is transferred onto the transfer sheet, the transfer voltage having the same polarity as that of the charged potential of the photosensitive drum 101 and an absolute value greater than the charged potential is applied to the transfer drum 131, thereby transferring the toner from the photosensitive drum 101 to the transfer sheet.

On the other hand, in case of the inversion developing method, after the image exposure is effected regarding the photosensitive drum 101 uniformly charged by the charge means 103, the toner is charged with the same polarity as the charging polarity of the charge means 103 to adhere the toner to the exposed area of the charged portion, and, when the toner image is transferred onto the transfer sheet, the transfer voltage having polarity opposite to that of the charged potential of the photosensitive drum 101 is applied to the transfer drum 131, thereby transferring the toner from the photosensitive drum 101 to the transfer sheet.

In both normal developing method and inversion developing method, to form a color image, the development and transferring are successively repeated by using the developing devices 104*a* to 104*d* so that four color toner images are superimposed on the transfer sheet. In this case, the charge is applied to the transfer sheet by the transfer voltage simultaneously with the transferring, thereby electrostatically holding the transfer sheet on the transfer drum 131. In order to improve the electrostatic absorption of the transfer sheet onto the transfer drum 131, the absorb roller 138 is arranged in the proximity of a place where the transfer sheet is supplied to the transfer drum 131, so that, after the transfer sheet is gripped by the grippers 5, by applying an absorbing voltage to the absorb roller, the transfer sheet is electrostatically absorbed to the transfer drum.

After the electricity on the transfer sheet to which the four color toner images were transferred is removed by the electricity removal charger 102 arranged around the transfer drum 131, the transfer sheet is separated from the transfer drum 131 by the separation pawl 124 arranged at a downstream side of the electricity removal charger 102, and then the transfer sheet is sent to the fixing device 125. In the fixing device, the four color toner images are fused and mixed to be fixed to the transfer sheet by heat and pressure, thereby forming a permanent full-color image. Thereafter, the transfer sheet is discharged out of the image forming apparatus. Preferably, the residual toner remaining on the transfer drum 131 from which the transfer sheet was separated is removed by the cleaner 127 including a cleaning member such as a fur brush, web or the like.

Further, substantially at the same time when the transfer sheet is separated from the transfer drum 131 by the separation pawl 124, the electricity removal roller 138 is abutted against the transfer drum 131, and the electricity on the transfer drum is removed by AC bias (for DC bias overlapped with the AC bias) applied to the electricity removal roller 138.

First Embodiment

Figure 1:
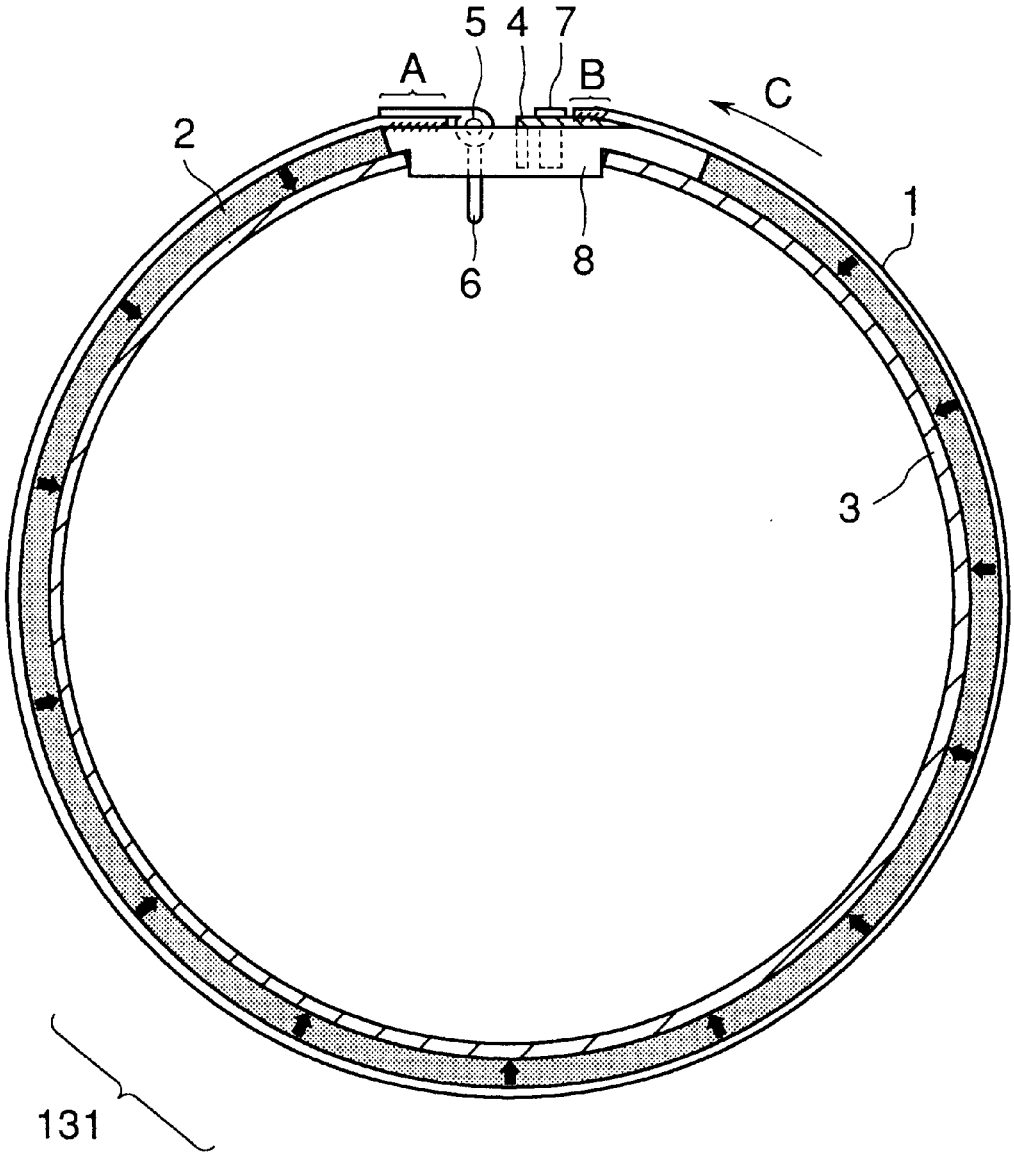
FIG. 1 is a cross-sectional view of a transfer drum according to a first embodiment of the present invention.
Figure 2:
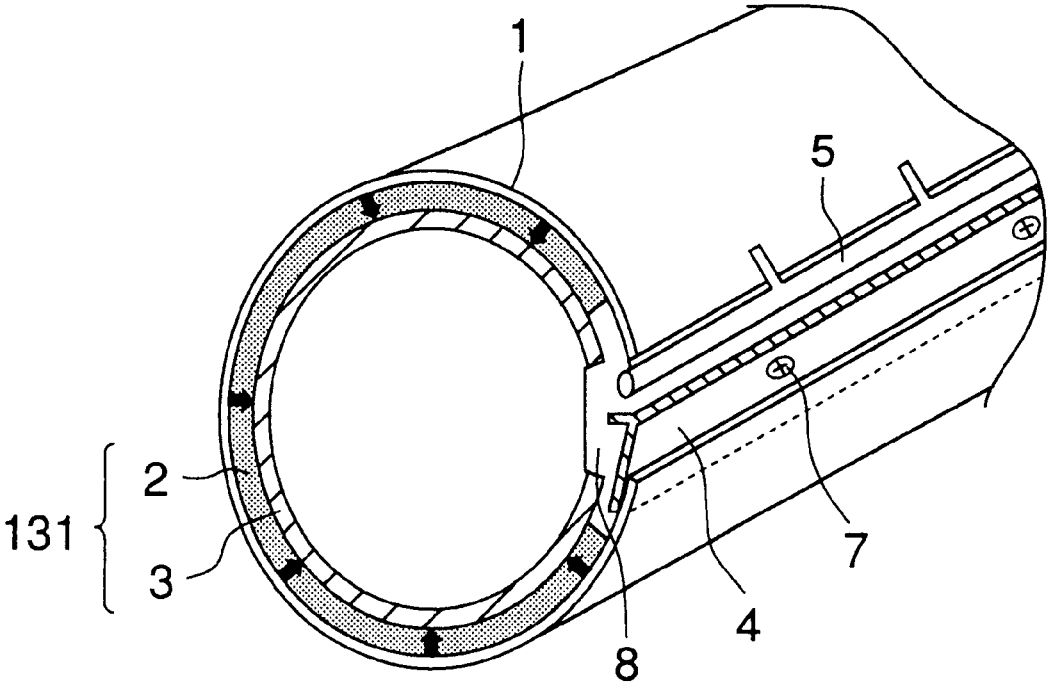
FIG. 2 is a partial perspective view of the transfer drum of FIG. 1.

FIG. 1 is a sectional view of a transfer drum 131 according to a first embodiment which can be applied to the image forming apparatus shown in FIG. 5, and FIG. 2 is a partial perspective view of the transfer drum.

Figure 7:
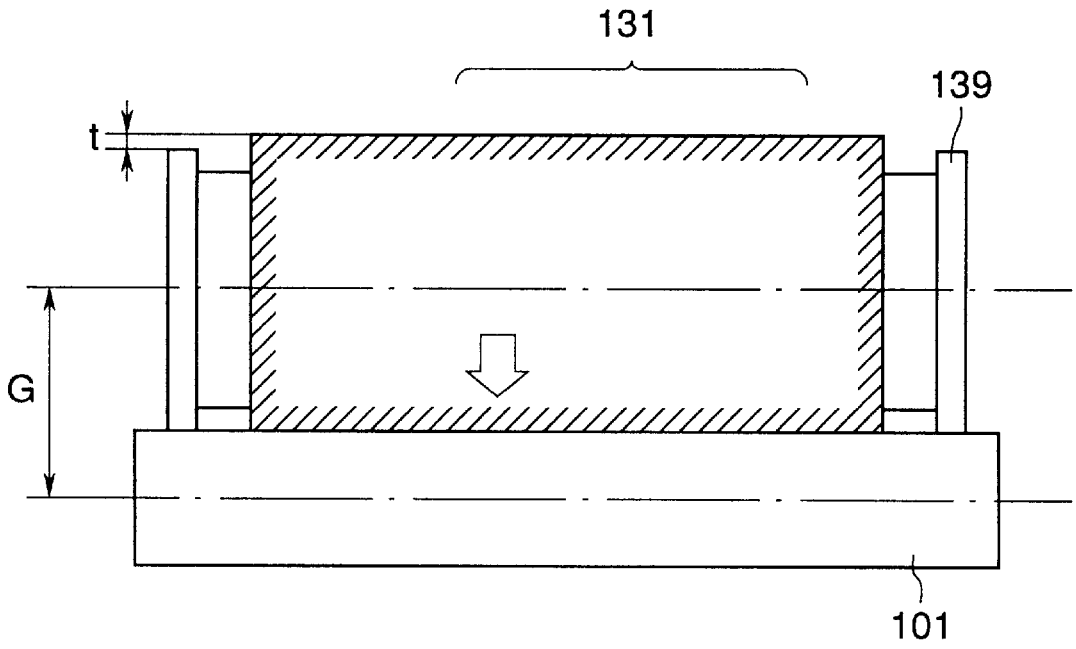
FIG. 7 is a view showing a relation between a photosensitive drum and the transfer drum.

The transfer drum 131 comprises a cylindrical conductive substrate 3 made of aluminium or the like, an elastic layer 2 made of foam rubber or foam resin and laminated on the peripheral surface of the substrate 3, and a dielectric sheet or film 1 coated on the elastic layer. In the illustrated embodiment, the elastic layer 2 is made of conductive urethane sponge having a thickness of about 6 mm (before the dielectric film 1 is coated thereon) and Asker F hardness of about 40. Further, the dielectric film 1 is formed from a polycarbonate sheet having a thickness of 100 $\mu$m. An outer diameter of the transfer drum 131 is 160 mm, and, as shown in FIG. 7, flanges (regulating members) 139 are arranged on both ends of the transfer drum 131 so that, when the transfer drum 131 is urged against the photosensitive drum 101, the thickness of the elastic layer 2 becomes about 5 mm at the nip between the transfer drum 131 and the photosensitive drum 101. Then, one end of the dielectric film 1 is bonded to the support member 8 (also acting as the support for the grippers 5 and secured to the conductive substrate 3) at a point A.

Incidentally, the grippers 5 can be opened and closed through levers 6. In this case, the dielectric film 1 is cut to a predetermined length and an L-shaped film fixing member 4 is bonded to the other end of the dielectric film at a point B. Then, the dielectric film 1 (secured at the point A) is wound around the elastic layer 2 while tensioning the film in a direction C to compress the elastic layer 2, and the L-shaped film fixing member 4 is secured to the support member 8 via pins 7. In this case, the length of the dielectric film 1 is predetermined so that the thickness of the elastic layer becomes 5.8 mm in the assembled condition. With this arrangement, the following advantages can be obtained.

(1) If the thickness of the elastic layer 2 (before enclosed by the dielectric film 1) is somewhat great, since the length of the dielectric film 1 is limited to the predetermined value, the outer diameter of the transfer drum 131 can be maintained to a predetermined value with high accuracy, so that the thickness margin of the elastic layer can be widened.

Figure 8A:
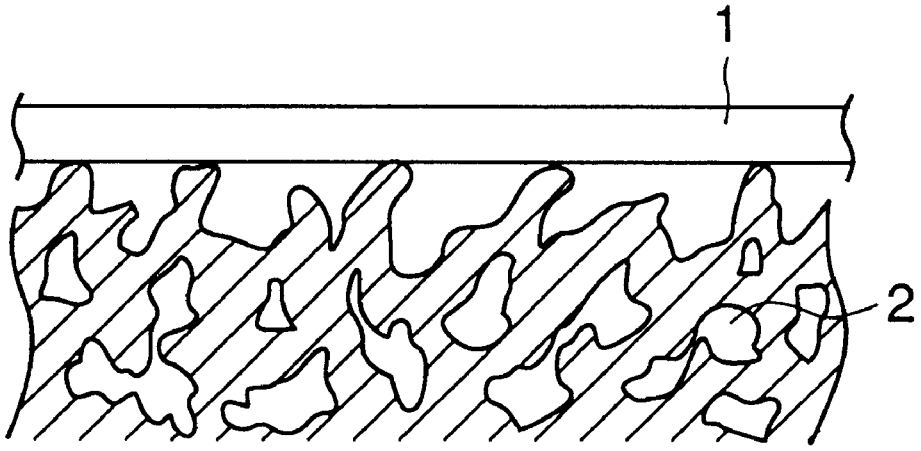
FIG. 8A is a partial sectional view of a dielectric film and an elastic layer before the elastic layer is compressed by the dielectric film.
Figure 8B:
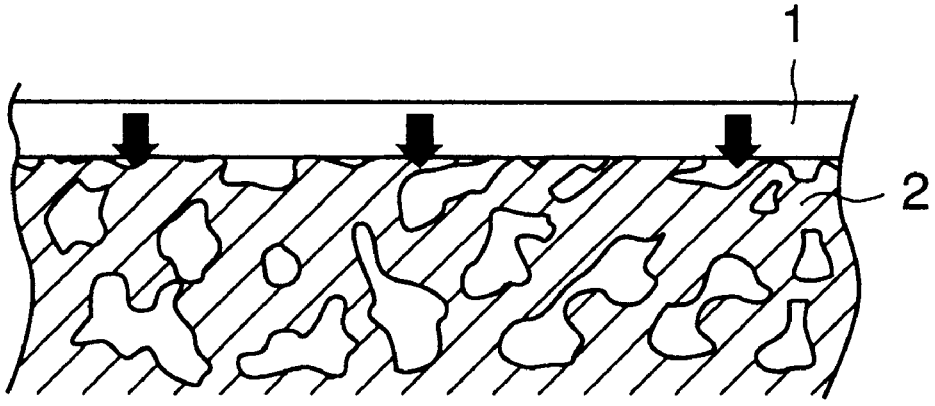
FIG. 8B is a partial sectional view of the dielectric film and the elastic layer after the elastic layer is compressed by the dielectric film.

(2) Since rough density portions of the elastic layer 2 in the proximity of the surface of the layer is compressed by the dielectric film 1 (i.e. shifted from a non-compressed condition as shown in FIG. 8A to a compressed condition as shown in FIG. 8B), even if there is dispersion in density and unevenness of the surface condition of the elastic layer in manufacture, the density can be made uniform and the unevenness can be corrected, thereby improving the conveying ability for the transfer sheet and preventing a bad influence for causing dispersion in registration and dispersion in color. Further, the close contact between the dielectric film 1 and the elastic layer 2 can be wholly improved, thereby improving the charge holding ability at the back surface of the dielectric film 1 to increase the absorbing force for absorbing the transfer sheet and the transferring ability.

(3) Moderate tension is applied to the dielectric film 1 by the restoring elasticity of the elastic layer 2, thereby preventing the poor transferring due to wrinkles on the surface of the transfer drum.

In fact, regarding the above advantage (1), when the thickness of the elastic layer (before enclosed by the dielectric film) is about 5.8–6.6 mm, it was found that the good image having no void could be obtained. On the other hand, when the thickness is too great, the compressed amount t of the elastic layer 2 by means of the dielectric film 1 also becomes too great, thereby increasing the hardness of the elastic layer to cause the void in the image.

In the illustrated embodiment, while an example that the elastic layer 2 is made of conductive urethane sponge was explained, the elastic layer may be made of independent or half-continuous foam 3-dimensional copolymer of ethylene/propylene (EPDM rubber), foam silicone rubber, or chloroprene rubber (CR rubber) having Asker F hardness of 40–80. Further, the dielectric film 1 may be made of polyimide, polyvinylidene fluoride (PVdF), polyethylene terephthalate (PET), nylon or the like having volume resistance of $10^{13}$–$10^{16}$ Ω·cm.

Incidentally, when the dielectric film 1 is made of material (such as nylon) which is apt to be deformed by tension, to prevent the deformation of the dielectric film, it is desirable that metallic mesh is provided on the back surface of the dielectric film or glass fibers are dispersed into the dielectric film. Furthermore, when a conductive layer is arranged on the back surface of the dielectric film 1 to permit the application of the transfer bias, since the conductivity treatment of the elastic layer 2 is not required, low hardness of the elastic film can be obtained effectively. In order to form the conductive layer, metal deposit may be used, conductive resin may be coated on the back surface of the dielectric film, the above-mentioned metallic mesh for increasing rigidity may also act as the conductive layer, or a thin conductive sheet may be pinched between the elastic layer 2 and the dielectric film 1.

Second Embodiment

Figure 3:
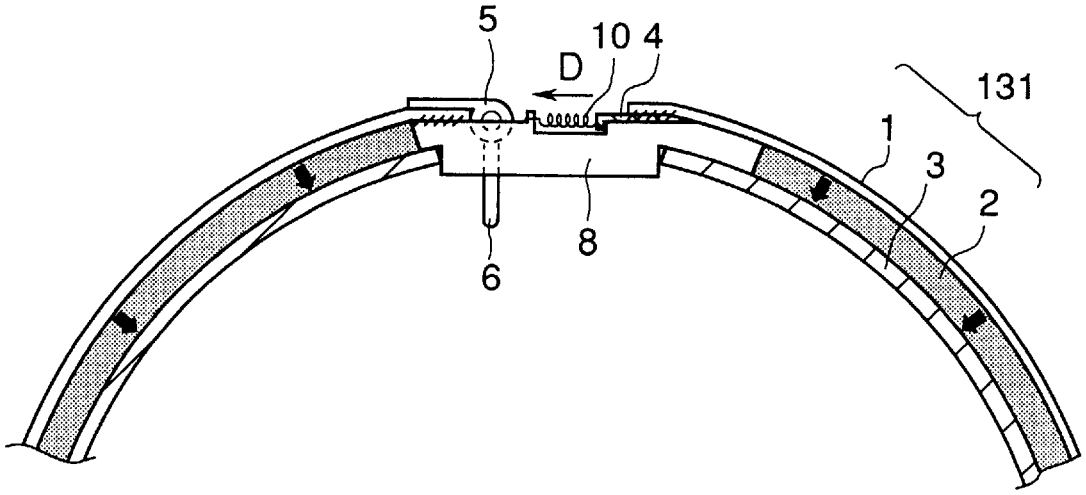
FIG. 3 is a partial cross-sectional view of a transfer drum according to a second embodiment of the present invention.

FIG. 3 shows a transfer drum 131 according to a second embodiment of the present invention, which can be applied to the image forming apparatus as shown in FIG. 5. In the first embodiment, the other end of the dielectric film 1 was secured to the support member 8 by using the film fixing member 4. In this case, the dielectric film 1 must be made of material which has adequate tensile strength and which is hard to be deformed.

To the contrary, when a dielectric film 1 which can be somewhat expanded is used, the film fixing member 4 is not secured to the support member 8, but is pulled in a direction D by means of springs 10, so that the reduction in tension force due to the elongation of the dielectric film 1 can be compensated. In this case, the total tension force of the springs may be 100–1000 grams. Incidentally, to regulate movement of the film fixing member 4 in an axial direction of the transfer drum 131, an axial slot for receiving the bent end of the film fixing member is preferably formed in the support member 8.

Third Embodiment

Figure 4:
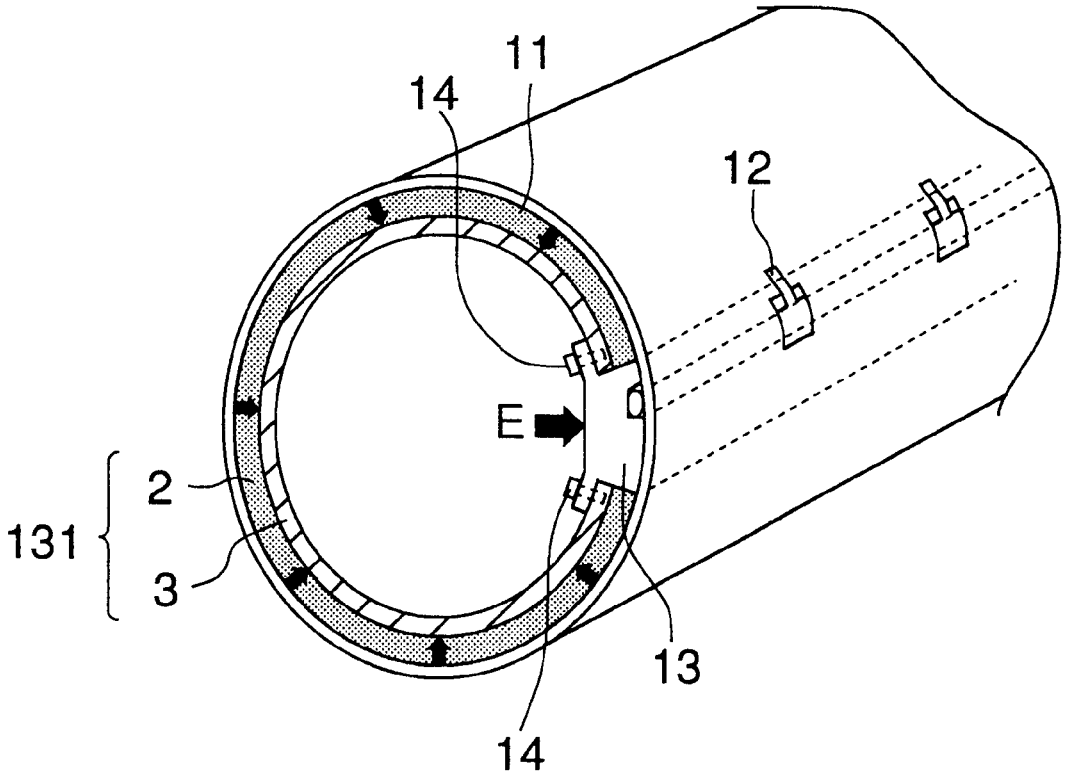
FIG. 4 is a partial perspective view of a transfer drum according to a third embodiment of the present invention.

FIG. 4 shows a transfer drum 131 according to a third embodiment, which can be applied to the image forming apparatus of FIG. 5.

In the first and second embodiments, while an example that the dielectric film 1 is secured to the support member 8 for supporting the grippers 5 was explained, as shown in FIG. 4, a continuous dielectric film 11 may be used. In this case, before a block 13 is assembled, a tube-shaped dielectric film 11 is fitted onto the elastic layer 2 on the substrate 3. In this case, since there is no block 13 in a notch of the substrate 3 (before assembling of the block), and, thus, outer diameter of the substrate is smaller, the dielectric film can easily be fitted onto the elastic layer 2 without compressing the elastic layer. Then, the block 13 is pushed into the notch of the substrate from a direction E, and the block is secured to the substrate by screws 14. Then, grippers 12 are secured to the block. In this way, the dielectric film 11 is urged from inside to outside by the screws 14 through the substrate 3, thereby causing the tension to compress the elastic layer 2. Since the dielectric film 11 has the tubular shape, ends of the film are not required to be bonded, thereby reducing the manufacturing cost. Incidentally, in order to form the tubular dielectric film 11, a centrifugal forming method may be utilized, as an example. Incidentally, in FIG. 4, while an example that the grippers 12 are used was explained, when the transfer sheet is absorbed to the transfer drum only by electrostatic absorbing force, the grippers 12 can be omitted and openings for passing the grippers are not required to be formed in the dielectric film 11.

Fourth Embodiment

In order to form the nip between the transfer drum and the photosensitive drum, the transfer drum may be urged against the photosensitive drum with uniform pressure, without positioning the transfer drum and the photosensitive drum. In this case, however, if the urging force between the photosensitive drum and the transfer drum becomes uneven, there arises the dispersion in rotation of the transfer drum, thereby disordering the color registration to cause the discrepancy in color.

To avoid this, in the first to third embodiments, as shown in FIG. 7, flanges (regulating members) 139 are provided on both ends of the transfer drum 131 so that the compressed amount t of the elastic layer of the transfer drum is regulated at the nip between the photosensitive drum and the transfer drum. With this arrangement, the outer diameter of the transfer drum 131 at positions other than the nip becomes greater than the outer diameter of each flange 139 by the compressed amount t. Further, in the first to third embodiments, the outer diameter of the transfer drum is 160 mm. In the case where the outer diameter of the transfer rotary member (transfer drum) is greater than about 120 mm, if the regulating members (flanges) are rotatably mounted on the shaft of the transfer rotary member, since bearing mechanisms for the regulating members become bulky and complex, in the present invention using the transfer drum having the large diameter of 160 mm, the regulating members 139 are secured to the shaft of the transfer rotary member. Accordingly, since the regulating members 139 are rotated simultaneously with the transfer drum 131, the peripheral speed of the transfer sheet absorbed to the surface of the transfer drum 131 becomes greater than those of the regulating members 139.

To the contrary, when the speed of the photosensitive drum 101 is equal to the speed of the transfer sheet on the transfer drum 131 to prevent the elongation and construction of the image during the transferring operation, the peripheral speed of each regulating member 139 becomes slower than that of the photosensitive drum 101. In this case, the photosensitive drum is worn (or a drum cylinder is worn when the regulating members are abutted against the drum cylinder on which the photosensitive layer is not formed) or the regulating members are worn.

To the contrary, in the illustrated embodiment, the peripheral speed $v_1$ of the photosensitive drum 101 is set to be substantially the same as the peripheral speed $v_2$ of the regulating member 139, and the speed $v_3$ of the transfer sheet on the transfer drum 131 at the transfer station is selected to have a relation $v_1 \cong v_2 < v_3$. The peripheral speed $v_1$ of the photosensitive drum 101 (FIG. 5) and a rotational speed of the polygon mirror 117 are relatively adjusted so that the toner image transferred to the transfer sheet moving at the speed $v_3$ has the same magnification as the initial image information and the image formed on the photosensitive drum is slightly contracted in the rotational direction of the photosensitive drum 101. The initial image information is image information inputted to form the image on the transfer sheet, i.e. image information before converted into the image information for forming the image on the photosensitive drum.

With this arrangement, the following advantages can be obtained.

(1) There is no difference in peripheral speed between the regulating members 139 and the photosensitive drum 101 at the abutment areas therebetween, thereby preventing the wear of the photosensitive drum and/or regulating members at the abutment areas.

(2) Since the transfer sheet is moved faster than the photosensitive drum 101, the void in the image can be prevented due to the sliding friction effect.

(3) Since the image formed on the photosensitive drum is slightly contracted (relative to the initial image information) in the rotational direction of the photosensitive drum 101, even when the transfer sheet on the transfer drum 131 is moved faster than the peripheral speed of the photosensitive drum 101, the elongation of the image on the transfer sheet can be prevented.

As an example, the outer diameter of the photosensitive drum 101 was 40 mm, the outer diameter of each regulating member 139 was 160 mm, the compressed amount t was 0.8 mm, the outer diameter of the transfer drum 131 (when not abutted against the photosensitive drum) was 161.6 mm, and $v_1=v_2=100$ mm/sec, $v_3=101$ mm/sec. In accordance with the above dimensions, the rotational speed of the polygon mirror 117 of FIG. 5 and the frequency of an image writing signal were adjusted so that the image was contracted in a sub-scan direction to obtain the magnification of 99% in the sub-scan direction on the photosensitive drum 101 (i.e. rotational direction of the photosensitive drum 101). As a result, it was found that the image was formed on the transfer sheet without any contraction and there was no void in the image. Further, the regulating members 139 and the photosensitive drum 101 were not worn at the abutment areas.

Incidentally, in the above example, the transfer drum 131 having the dielectric film 1 and the elastic layer 2 as is in the first to third embodiments can be used. Further, by combining the first to third embodiments and the fourth embodiment, the compressed amount t can be regulated more correctly, thereby achieving good results.

What is claimed is:

1. An image forming apparatus comprising:

an image bearing member for bearing an image thereon; and a movable member abutted against said image bearing member to transfer the image on said image bearing member, said movable member including a substrate, a sheet-like member made of a dielectric film, and an elastic layer disposed between said substrate and said sheet-like member, said elastic layer having a hardness of 40 to 80 degrees measured by Asker F hardness measuring method and a thickness of 3 to 10 mm, and compressed by a tension force of said sheet-like member to a predetermined thickness before said movable member is abutted against said image bearing member.

2. An image forming apparatus according to claim 1, wherein said sheet-like member can bear a transfer material thereon, and the image on said image bearing member is transferred onto the transfer material borne on said sheet-like member.

3. An image forming apparatus according to claim 3, wherein plural color images are successively superimposed on the transfer material borne on said sheet-like member to obtain a full-color image.

4. An image forming apparatus according to claim 3, wherein said substrate is conductive, and a voltage is applied to said substrate to transfer the image on said image bearing member onto the transfer material borne on said sheet-like member.

5. An image forming apparatus according to claim 3, wherein said movable member comprises a conductive layer between said sheet-like member and said elastic layer, and a voltage is applied to said conductive layer to transfer the image on said image bearing member onto the transfer material borne on said sheet-like member.

6. An image forming apparatus according to claim 2, wherein said substrate and said elastic layer are provided at an area where the transfer material is borne on said sheet-like member.

7. An image forming apparatus according to claim 1, wherein said movable member comprises a support portion for supporting an end of said sheet-like member in a moving direction of said movable member.

8. An image forming apparatus according to claim 7, wherein said movable member comprises an elastic member for maintaining the tension in said sheet-like member, said elastic member being disposed at said support portion.

9. An image forming apparatus according to claim 1, wherein said sheet-like member comprises an endless cylindrical member.

10. An image forming apparatus according to claim 9, wherein said movable member comprises an urging member for urging said substrate toward said sheet-like member.

11. An image forming apparatus according to claim 1, wherein said substrate is cylindrical and comprises a notch in a circumferential direction.

12. An image forming apparatus according to claim 1, wherein said elastic layer is electroconductive.

13. An image forming apparatus comprising:

an image bearing member for bearing an image thereon; and a movable member abutted against said image bearing member to transfer the image on said image bearing member, said movable member including a substrate, a sheet-like member, and an elastic layer disposed between said substrate and said sheet-like member and compressed to a predetermined thickness before said movable member is abutted against said image bearing member, and wherein said sheet-like member can bear a transfer material thereon, and the image on said image bearing member is transferred onto the transfer material borne on said sheet-like member, and wherein said sheet-like member includes therein a reinforcing means for increasing a tensile strength of said sheet-like member.

14. An image forming apparatus according to claim 13, wherein said reinforcing means is conductive, and a voltage is applied to said reinforcing means to transfer the image on said image bearing member onto the transfer material borne on said sheet-like member.

15. An image forming apparatus comprising:

an image bearing member for bearing an image thereon; and a movable member abutted against said image bearing member to transfer the image on said image bearing member, said movable member including a substrate, a sheet-like member, and an elastic layer disposed between said substrate and said sheet-like member and compressed to a predetermined thickness before said movable member is abutted against said image bearing member, wherein said movable member is abutted against said image bearing member and comprises position regulating means for regulating positions of said image bearing member and said movable member, and, when a moving speed of said image bearing member is $v_1$, a moving speed of said position regulating means if $v_2$ and a moving speed of a surface of said movable member at an abutment area between said image bearing member and said movable member is $v_3$, the following relation is satisfied:

$$v_1 \cong v_2 < v_3.$$

16. An image forming apparatus according to claim 14, wherein the image formed on said image bearing member is contracted relative to initial image information in a moving direction of said image bearing member.

17. An image forming apparatus comprising:

an image bearing member for bearing an image thereon; and a movable member abutted against said image bearing member to transfer the image on said image bearing member, said movable member including a substrate, a sheet-like member, and an elastic layer disposed between said substrate and said sheet-like member;

wherein said elastic layer is compressed by a tension force of said sheet-like member to a predetermined thickness before said movable member is abutted against said image bearing member.

18. An image forming apparatus according to claim 17, wherein said sheet-like member can bear a transfer material thereon, and the image on said image bearing member is transferred onto the transfer material borne on said sheet-like member.

19. An image forming apparatus according to claim 18, wherein plural color images are successively superimposed on the transfer material borne on said sheet-like member to obtain a full-color image.

20. An image forming apparatus according to claim 18, wherein said substrate is conductive, and a voltage is applied to said substrate to transfer the image on said image bearing member onto the transfer material borne on said sheet-like member.

21. An image forming apparatus according to claim 18, wherein said movable member comprises a conductive layer between said sheet-like member and said elastic layer, and a voltage is applied to said conductive layer to transfer the image on said image bearing member onto the transfer material borne on said sheet-like member.

22. An image forming apparatus according to claim 18, wherein said substrate and said elastic layer are provided at an area where the transfer material is borne on said sheet-like member.

23. An image forming apparatus according to claim 17, wherein said movable member comprises a support portion for supporting an end of said sheet-like member in a moving direction of said movable member.

24. An image forming apparatus according to claim 23, wherein said movable member comprises an elastic member for maintaining the tension in said sheet-like member, said elastic member being disposed at said support portion.

25. An image forming apparatus according to claim 17, wherein said sheet-like member comprises an endless cylindrical member.

26. An image forming apparatus according to claim 25, wherein said movable member comprises an urging member for urging said substrate toward said sheet-like member.

27. An image forming apparatus according to claim 17, wherein said substrate is cylindrical and comprises a notch in a circumferential direction.

28. An image forming apparatus according to claim 17, wherein said elastic layer is electroconductive.

29. An image forming apparatus according to claim 17, wherein said sheet-like member is a dielectric film.

30. An image forming apparatus comprising:

an image bearing member for bearing an image thereon; and a movable member abutted against said image bearing member to transfer the image on said image bearing member, said movable member including a substrate, a sheet-like member, and an elastic layer disposed between said substrate and said sheet-like member, said elastic layer having a hardness of 40 to 80 degrees measured by Asker F hardness measuring method and a thickness of 3 to 10 mm in an uncompressed state, and compressed by a tension force of said sheet-like member to a predetermined thickness before said movable member is abutted against said image bearing member.

31. An image forming apparatus according to claim 30, wherein said sheet-like member can bear a transfer material thereon, and the image on said image bearing member is transferred onto the transfer material borne on said sheet-like member.

32. An image forming apparatus according to claim 31, wherein plural color image are successively superimposed on the transfer material borne on said sheet-like member to obtain a full-color image.

33. An image forming apparatus according to claim 31, wherein said substrate is conductive, and a voltage is applied to said substrate to transfer the image on said image bearing member onto the transfer material borne on said sheet-like member.

34. An image forming apparatus according to claim 31, wherein said movable member comprises a conductive layer between said sheet-like member and said elastic layer, and a voltage is applied to said conductive layer to transfer the image on said image bearing member onto the transfer material borne on said sheet-like member.

35. An image forming apparatus according to claim 31, wherein said substrate and said elastic layer are provided at an area where the transfer material is borne on said sheet-like member.

36. An image forming apparatus according to claim 30, wherein said movable member comprises a support portion for supporting an end of said sheet-like member in a moving direction of said movable member.

37. An image forming apparatus according to claim 36, wherein said movable member comprises an elastic member for maintaining the tension in said sheet-like member, said elastic member being disposed at said support portion.

38. An image forming apparatus according to claim 30, wherein said sheet-like member comprises an endless cylindrical member.

39. An image forming apparatus according to claim 38, wherein said movable member comprises an urging member for urging said substrate toward said sheet-like member.

40. An image forming apparatus according to claim 30, wherein said substrate is cylindrical and comprises a notch in a circumferential direction.

41. An image forming apparatus according to claim 30, wherein said elastic layer is electroconductive.

42. An image forming apparatus according to claim 30, wherein said sheet-like member is a dielectric film.

* * * * *

UNITED STATES PATENT AND TRADEMARK OFFICE

CERTIFICATE OF CORRECTION

PATENT NO. : 6,151,477
DATED : November 21, 2000
INVENTOR(S) : Akihiko Takeuchi, et al.

It is certified that error appears in the above-identified patent and that said Letters Patent is hereby corrected as shown below:

Column 1,
Line 56, "an" should read -- a --.

Column 2,
Line 52, "drum; and" should read -- drum; --.
Line 55, "film, and" should read -- film, and --.

Column 4,
Line 36, "in" should be deleted.
Line 49, "formating" should read -- forming --.

Column 6,
Line 23, "to" should read -- at --.

Column 8,
Line 54, "before" should read -- before being --.

Column 9,
Line 49, "claim 3," should read -- claim 2, --.
Line 53, "claim 3," should read -- claim 2, --.
Line 58, "claim 3," should read -- claim 2, --.

Column 11,
Line 1, "claim 14," should read -- claim 15, --.

Column 12,
Line 21, "image" should read -- images --.

Signed and Sealed this

Second Day of October, 2001

*Attest:*

Nicholas P. Godici

*Attesting Officer*

NICHOLAS P. GODICI
*Acting Director of the United States Patent and Trademark Office*